United States Patent [19]

Broze et al.

[11] Patent Number: 4,622,173

[45] Date of Patent: Nov. 11, 1986

[54] NON-AQUEOUS LIQUID LAUNDRY DETERGENTS CONTAINING THREE SURFACTANTS INCLUDING A POLYCARBOXYLIC ACID ESTER OF A NON-IONIC

[75] Inventors: Guy Broze, Grace-Hollogne; Danielle Bastin, Soumagne, both of Belgium

[73] Assignee: Colgate-Palmolive Co., New York, N.Y.

[21] Appl. No.: 687,816

[22] Filed: Dec. 31, 1984

[51] Int. Cl.[4] ..... C11D 1/06; C11D 1/62; C11D 1/72; C11D 1/74

[52] U.S. Cl. ..... 252/528; 252/89.1; 252/135; 252/174.21; 252/174.22; 252/547; 252/DIG. 1; 252/DIG. 14

[58] Field of Search ..... 252/8.8, 135, 174.21, 252/174.22, 528, 547, DIG. 14

[56] References Cited

U.S. PATENT DOCUMENTS

| | | | |
|---|---|---|---|
| 3,134,840 | 5/1964 | Minegishi | 252/8.9 |
| 3,594,409 | 7/1971 | Lachampt | 424/61 |
| 3,630,929 | 12/1971 | Van Dijk | 252/136 |
| 3,741,911 | 6/1973 | Shane | 252/527 |
| 3,990,991 | 11/1976 | Gerstein | 252/542 |
| 4,264,457 | 4/1981 | Beeks | 252/8.75 |
| 4,316,812 | 2/1982 | Hancock | 252/99 |
| 4,362,530 | 12/1982 | Gross | 8/529 |
| 4,443,362 | 4/1984 | Guth | 252/545 |
| 4,473,489 | 9/1984 | Bartnick | 252/354 |

FOREIGN PATENT DOCUMENTS 1419351 12/1975 United Kingdom .

*Primary Examiner*—Dennis L. Albrecht
*Attorney, Agent, or Firm*—Herbert S. Sylvester; Murray M. Grill; Norman Blumenkopf

[57] ABSTRACT

A mixture of an acid terminated non-ionic surfactant and a quaternary ammonium salt surfactant provide better detergency than equivalent amounts of either of the surfactant compounds alone. The surfactant mixture is preferably used in conjunction with liquid non-ionic surfactant in heavy duty non-aqueous laundry detergents but can also be used in aqueous liquid detergent compositions and powder detergent compositions.

12 Claims, No Drawings

NON-AQUEOUS LIQUID LAUNDRY DETERGENTS CONTAINING THREE SURFACTANTS INCLUDING A POLYCARBOXYLIC ACID ESTER OF A NON-IONIC

The invention relates to laundry detergent compositions. More particularly, this invention relates to laundry detergents with improved detergency obtained from a mixture of an acid-terminated non-ionic surfactant with a quaternary ammonium salt surfactant.

There have been many disclosures in the art relating to detergency compositions containing cationic softening agents, including the quaternary ammonium compound softening agents, some of which may also function as cleaning or surfactant compounds, with non-ionic surface-active compounds. As representative of this art, mention can be made of U.S. Pat. Nos. 4,264,457, 4,239,659, 4,259,217, 4,222,905, 3,951,879, 3,360,470, 3,351,483, 3,644,203, etc. In addition, U.S. Pat. Nos. 3,537,993, 3,583,912, 3,983,079, 4,203,872, and 4,264,479 specifically disclose combinations of non-ionic surface-active agent, cationic fabric softener and another ionic surfactant or modifier, such as zwitterionic surfactants, amphoteric surfactants, and the like.

U.S. Pat. No. 4,222,905 to Cockrell, Jr. discloses laundry detergent compositions which may be in liquid form and which are formulated from certain non-ionic surfactants and certain cationic surfactants, at a non-ionic:cationic weight ratio of from 5:1 to about 1:1.

Non-ionic/cationic mixed surfactant detergent compositions having a non-ionic:cationic weight ratio of from about 1:1 to 40:1, in which the non-ionic surfactant is limited to the class having a hydrophilic-lipophilic balance (HLB) of from about 5 to about 17, and wherein the cationic surfactant is limited to the class of mono-higher alkyl quaternary ammonium compounds in which the higher alkyl has from about 20 to about 30 carbon atoms, are disclosed by Murphy in U.S. Pat. No. 4,239,659.

On the other hand, it is also known, as disclosed in the commonly assigned copending application Ser. No. 597,948 filed Apr. 9, 1984, now abandoned, the disclosure of which is incorporated by reference, that acid-terminated non-ionic surfactants can function as viscosity control and gel inhibiting agents for improving dispensibility, dispersibility and stability of non-aqueous liquid non-ionic surfactant compositions. Furthermore, it is also disclosed in this application that when added to the wash solution the acid-terminated non-ionic surfactant is converted to an anionic surfactant. Nevertheless, the acid-terminated non-ionic surfactants are not considered to substantially contribute to the overall cleaning performance, i.e. detergency, of the non-ionic surfactant composition.

There remains a need in the art to provide further improvements in detergency of both liquid and powdery detergent compositions so that, for example, the compositions can be provided in more concentrated form with a consequential improvement in reduction of packaging costs and the convenience to the consumer.

It has now been discovered that the detergency of the acid-terminated non-ionic surfactants are synergistically promoted by the presence of a quaternary ammonium salt surfactant While improved cleaning performance can be obtained over relatively wide ratios of the acid-terminated non-ionic and the quaternary ammonium salt surfactant, best cleaning performance has been observed at approximately 1:1 molar ratios.

Accordingly, in one aspect, the present invention provides a detergent composition comprising a mixture of an acid-terminated non-ionic surfactant with a quaternary ammonium salt surfactant.

In a more preferred embodiment, the present invention provides heavy duty laundry liquid non-ionic detergent compositions wherein the detergency of the non-ionic surfactant detergent compound is enhanced due to the synergistic effect between a mixture of an acid-terminated non-ionic surfactant and a cationic surfactant.

In addition to the heavy duty laundry liquid non-ionic detergent compositions, the present invention provides, in other embodiments, aqueous liquid laundry detergent compositions, and solid detergent compositions having improved detergency due to the presence therein of a mixture of an acid-terminated non-ionic surfactant and a cationic surfactant.

The acid terminated non-ionic surfactant which is one essential component of the detergent compositions of this invention, can be considered a non-ionic surfactant which has been modified to convert a free hydroxyl (OH) group thereof to a moiety having a carboxyl (COOH) group, for example, by reaction with a polycarboxylic acid anhydride, e.g. succinic anhydride. More specifically, the non-ionic surfactant is of the type having an organic hydrophobic moiety and an organic hydrophilic moiety, the latter including an hydroxyl group at its terminus in which the terminal hydroxyl group is modified to a moiety having a carboxyl group. Preferably, the reaction product between the non-ionic surfactant and the polycarboxylic acid anhydride forms the partial, e.g. half, ester of the polycarboxylic acid.

Specific examples of the acid-terminated non-ionic surfactant and the manner of preparation thereof are shown below.

EXAMPLE A 400 g of a non-ionic surfactant which is a $C_{13}$–$C_{15}$ alkanol which has been alkoxylated to introduce 6 ethylene oxide and 3 propylene oxide units per alkanol unit (Plurafac RA30) is mixed with 32 g of succinic anhydride and heated for 7 hours at 100° C. The mixture is then cooled and filtered to remove unreacted succinic anhydride. Infrared analysis indicates that about one-half of the non-ionic surfactant has been converted to the acidic half ester thereof. The resulting product, therefore, is a mixture of about equal parts of unmodified nonionic surfactant and its acid-terminated half ester thereof and the mixture can be used as such without separation of the unmodified non-ionic surfactant.

EXAMPLE B 522 g of the non-ionic surfactant sold under the tradename Dobanol 25-7 (the product of ethoxylation of a $C_{12}$–$C_{15}$ alkanol, which product has about 7 ethylene oxide units per molecule of alkanol) is mixed with 100 g of succinic anhydride and 0.1 g of pyridine (which acts as an esterification catalyst) and heated at 260° C. for 2 hours, cooled and filtered to remove unreacted succinic material. Infrared analysis indicates that substantially all of the free hydroxyls of the surfactant have reacted.

Other esterification catalysts, such as, for example, alkali metal alkoxides such as sodium methoxide, may be used in place of, or in admixture with, the pyridine.

EXAMPLE C

Example B is repeated using 1000 g of Dobanol 91-5 (the product of ethoxylation of a $C_9$–$C_{11}$ alkanol, which product has about 5 ethylene oxide units per molecule of alkanol) and 265 g of succinic anhydride.

In the foregoing examples, the carboxylic acid moiety is joined to the residue of the non-ionic surfactant by a carboxylic ester linkage. Instead of succinic acid anhydride, other polycarboxylic acid and acid anhydride compounds may be used, for example, maleic acid, maleic anhydride, glutaric acid, malonic acid, phthalic acid, phthalic anhydride, citric acid, and the like.

Furthermore, it is also within the scope of the present invention to use linkages other than the carboxylic ester linkages, such as ether, thioether, or urethane linkages, formed by conventional reactions. For instance, to form an ether linkage, the non-ionic surfactant may be treated with a strong base (to convert its hydroxyl group to an ONa group, for instance) and then reacted with a halocarboxylic acid such as chloroacetic acid or chloropropionic acid or the corresponding bromo compound. Thus, the resulting carboxylic acid may have the formula R—Y—ZCOOH where R is the residue of a non-ionic surfactant (on removal of a terminal OH), Y is oxygen or sulfur, and Z represents an organic linkage such as hydrocarbon group of, for example, 1 to 10 carbon atoms, which may be attached to the oxygen (or sulfur) of the formula directly or by means of an intervening linkage such as an oxygen-or nitrogen-containing linkage, for example, $$-\overset{\overset{\displaystyle O}{\|}}{C}- \text{ or } -\overset{\overset{\displaystyle O}{\|}}{C}-NH-.$$

The nonionic synthetic organic detergents employed in the practice of the invention as a precursor of the acid-terminated non-ionic surfactant, or directly as non-ionic surfactant, may be any of a wide variety of such compounds, which are well known and, for example, are described at length in the text *Surface Active Agents,* Vol. II, by Schwartz, Perry and Berch, published in 1958 by Interscience Publishers, and in McCutcheon's *Detergents and Emulsifiers,* 1969 Annual, the relevant disclosures of which are hereby incorporated by reference. Usually, the nonionic detergents are poly-lower alkoxylated lipophiles wherein the desired hydrophile-lipophile balance is obtained from addition of a hydrophilic poly-lower alkoxy group to a lipophilic moiety. A preferred class of the nonionic detergent employed is the poly-lower alkoxylated higher alkanol wherein the alkanol is of 10 to 18 carbon atoms and wherein the number of mols of lower alkylene oxide (of 2 or 3 carbon atoms) is from 3 to 12. Of such materials it is preferred to employ those wherein the higher alkanol is a higher fatty alcohol of 10 to 11 or 12 to 15 carbon atoms and which contain from 5 to 8 or 5 to 9 lower alkoxy groups per mol. Preferably, the lower alkoxy is ethoxy but in some instances, it may be desirably mixed with propoxy, the latter, if present, usually being a minor (less than 50%) proportion. Exemplary of such compounds are those wherein the alkanol is of 12 to 15 carbon atoms and which contain about 7 ethylene oxide groups per mol, e.g. Neodol 25-7 and Neodol 23-6.5, which products are made by Shell Chemical Company, Inc. The former is a condensation product of a mixture of higher fatty alcohols averaging about 12 to 15 carbon atoms, with about 7 mols of ethylene oxide and the latter is a corresponding mixture wherein the carbon atom content of the higher fatty alcohol is 12 to 13 and the number of ethylene oxide groups present averages about 6.5. The higher alcohols are primary alkanols. Other examples of such detergents include Tergitol® 15-S-7 and Tergitol 15-S-9, both of which are linear secondary alcohol ethoxylates made by Union Carbide Corp. The former is a mixed ethoxylation product of 11 to 15 carbon atoms linear secondary alkanol with seven mols of ethylene oxide and the latter is a similar product but with nine mols of ethylene oxide being reacted.

One particularly preferred group of non-ionic surfactants based on linear secondary alkanols are those available from British Petroleum Co. under the designation "Surfactant T." The "Surfactant T" non-ionics are obtained by ethoxylation of secondary $C_{13}$ fatty alcohols and have a narrow distribution of ethylene oxide (EO) units from molecule to molecule and have the following characteristics:

| Nonionic | EO Content | Pour Point (C.°) | Cloud Point (1% sol'n) (°C.) |
|---|---|---|---|
| Surfactant T5 | 5 | <−2 | <25 |
| Surfactant T7 | 7 | −2 | 38 |
| Surfactant T8* | 8 | 2 | 48 |
| Surfactant T9 | 9 | 6 | 58 |
| Surfactant T12 | 12 | 20 | 88 |

*"Surfactant T8" was artificially prepared by mixing equal amounts of Surfactant T7 and Surfactant T9 (1:1 mixture)

The nonionic surfactant which is a linear secondary $C_{13}$ fatty alcohol condensed with an average 8 moles ethylene oxide per mole of fatty alcohol, and in which there are substantially no molecules containing less than 7 or more than 9 moles EO, such as less than 10% by weight, preferably less than 3% by weight, in total, of the low and high EO substitutions, is an especially preferred liquid non-ionic surfactant in view of its good balance between relatively low pour point, relative high cloud point and primarily because it is capable of resisting forming a gel when added to cold water, for example, at temperatures as low as about 5° C. or lower.

Also useful in the present compositions as a component of the non-ionic detergent are higher molecular weight non-ionics. such as Neodol 45-11, which are similar ethylene oxide condensation products of higher fatty alcohols, with the higher fatty alcohol being of 14 to 15 carbon atoms and the number of ethylene oxide groups per mol being about 11. Such products are also made by Shell Chemical Company.

Other useful non-ionics are represented by the Plurafac series from BASF Chemical Company which are the reaction product of a higher linear alcohol and a mixture of ethylene and propylene oxides, containing a mixed chain of ethylene oxide and propylene oxide, terminated by a hydroxyl group. Examples include Plurafac RA30, Plurafac RA40 (a $C_{13}$–$C_{15}$ fatty alcohol condensed with 7 moles propylene oxide and 4 moles ethylene oxide), Plurafac D25 (a $C_{13}$–$C_{15}$ fatty alcohol condensed with 5 moles propylene oxide and 10 moles ethylene oxide) and Plurafac B26. Another group of preferred liquid non-ionics are available from Shell Chemical Company, Inc. under the Dobanol trademark: Dobanol 91-5 is an ethoxylated $C_9$–$C_{11}$ fatty alcohol with an average of 5 moles ethylene oxide; Dobanol 25-7 is an ethoxylated $C_{12}$–$C_{15}$ fatty alcohol with an average of 7 moles ethylene oxide; etc.

In the preferred poly-lower alkoxylated higher alkanols, to obtain the best balance of hydrophilic and lipophilic moieties the number of lower alkoxies will usually be from 40% to 100% of the number of carbon atoms in the higher alcohol, preferably 40 to 60% thereof and the non-ionic detergent will preferably contain at least 50% of such preferred poly-lower alkoxy higher alkanol. Higher molecular weight alkanols and various other normally solid non-ionic detergents and surface active agents may be contributory to gelation of the liquid detergent and consequently, will preferably be omitted or limited in quantity in the compositions of the present invention which are in the form of non-aqueous liquids, although minor proportions thereof may be employed for their cleaning properties, etc. With respect to both preferred and less preferred non-ionic detergents, the alkyl groups present therein are generally linear, although branching may be tolerated, such as at a carbon next to or two carbons removed from the terminal carbon of the straight chain and away from the ethoxy chain, if such branched alkyl is not more than three carbons in length. Normally, the proportion of carbon atoms in such a branched configuration will be minor rarely exceeding 20% of the total carbon atom content of the alkyl. Similarly, although linear alkyls which are terminally joined to the ethylene oxide chains are highly preferred and are considered to result in the best combination of detergency, biodegradability and non-gelling characteristics, medial or secondary joinder to the ethylene oxide in the chain may occur as in the Surfactant T non-ionics described above. When propylene oxide is present in the lower alkylene oxide chain, it will usually be less than 20% thereof and preferably less than 10% thereof.

When greater proportions of non-terminally alkoxylated alkanols, propylene oxide-containing poly-lower alkoxylated alkanols and less hydrophile-lipophile balanced non-ionic detergents than mentioned above are employed and when other non-ionic detergents are used instead of the preferred non-ionics recited herein, the product resulting may not have as good detergency, stability, viscosity and non-gelling properties as the preferred non-aqueous liquid compositions but use of viscosity and gel controlling compounds can also improve the properties of the detergents based on such non-ionics. In some cases, as when a higher molecular weight poly-lower alkoxylated higher alkanol is employed, often for its detergency, the proportion thereof will be regulated or limited as in accordance with the results of various experiments, to obtain the desired detergency and still have the product non-gelling and of desired viscosity. Also, it has been found that it is only rarely necessary to utilize the higher molecular weight non-ionics for their detergent properties since the preferred non-ionics described herein are excellent detergents and additionally, permit the attainment of the desired viscosity in the liquid detergent without gelation at low temperature. Of course, there will be a broader latitude in the selection of the non-ionic surfactant for the aqueous and solid detergent compositions of this invention. Mixtures of two or more of these liquid non-ionics can also be used and in some cases advantages can be obtained by the use of such mixtures.

The acid-terminated non-ionic surfactant is used as its admixture with a cationic surfactant to provide synergistic levels of detergency. Substantially any cationic substance having surface-active properties can be used in conjunction with the acid-terminated non-ionic surfactant. A particularly preferred class of the cationic surfactant is the ethoxylated quaternary ammonium salt surfactant compounds which are mono-, or poly-ethoxylated with up to about 12 ethylene oxide groups, attached at one or two of the four available positions on the quaternary nitrogen atom.

More generally, however, any of the cationic surfactant compounds disclosed in the aforementioned U.S. Pat. No. 4,259,217 to Murphy, et al in columns 8 to 15, inclusive, the disclosure of which is incorporated herein by reference thereto, can also be used in the compositions of this invention.

The particularly preferred cationic surfactants referred to above have the general formula

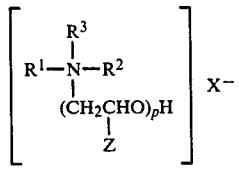

wherein $R^1$ is an organic group containing a straight or branched alkyl or alkenyl group optionally substituted with up to 3 phenyl or hydroxy groups, and optionally interrupted by up to 4 structures selected from the group consisting of

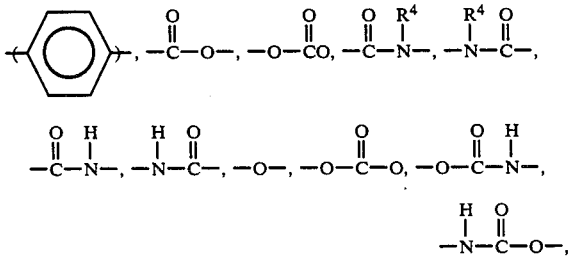

and mixtures thereof, where $R^4$ is an alkyl or hydroxyalkyl group containing 1 to 4 carbon atoms, or a benzyl group, and which contains from about 8 to 22 carbon atoms, and which may additionally contain up to 12 ethylene oxide groups, $R^2$ is the group $R^1$ or an alkyl or hydroxyalkyl group containing 1 to 6 carbon atoms, or a benzyl group; $R^3$ is the group $R^2$ or $(CH_2CHZO)_qH$; Z is hydrogen or methyl, and q and p are, independently, numbers from 1 to 12; and X is a water-soluble anion, such as halide, methyl sulfate, sulfate, nitrate, etc.

Preferably, in the above formula, $R^1$ is an alkyl or alkenyl group having from about 10 to 20 carbon atoms which may optionally be substituted by an hydroxyl group, and which may additionally contain up to 12 ethylene oxide groups; $R^2$ is the group $R^1$ or an alkyl or hydroxyalkyl group containing 1 to 4 carbon atoms, or a benzyl group; $R^3$ is the group $R^2$ or $(C_2H_4O)_qH$; Z is a hydrogen atom; and q and p are, independently, numbers from 1 to 12.

Examples of the cationic ethoxylated quaternary ammonium surfactant compounds include, dipolyethoxy lauryl hydroxy ethyl ammonium chloride, dipolyethoxy stearyl methyl ammonium chloride, polyethoxy distearyl methyl ammonium chloride, N-polyethoxy N-polyethoxylated $C_{16}$ alkyl N,N-dimethyl ammonium chloride, dipolyethoxy palmitylalkyl methyl ammonium methosulfate, etc.

Specific examples of this class of cationic surfactant include N-ethyl N-cocoammonium ethoxylate (15) bisulfate (Quaternium-54) wherein the total amount of ethoxylation averages 15 moles of ethylene oxide per mole of quaternary nitrogen, N-methyl-N-oleylammonium ethoxylate(2) wherein there are an average of 2 moles of ethylene oxide per mole of quaternary nitrogen, N-methyl-N-stearylammonium propoxylate(15) bisulfate, wherein there are an average of 15 moles of propylene oxide per quaternary nitrogen, and the like.

In the preferred embodiment of the invention, the acid-terminated nonionic surfactant and the cationic surfactant are combined in substantially a 1:1 molar complex. However, molar excesses of either component can also be used, for example, molar ratios of acid-terminated nonionic to cationic may broadly fall within the range of from about 4:1 to 1:4, preferably 1.5:1 to 1:1.5.

While the mixture of the acid-terminated non-ionic surfactant and cationic surfactant provide enhanced detergency when used alone, it is preferred to use the surfactant mixture in combination with at least one other surfactant. In the preferred liquid detergent compositions, the other surfactant is preferably one of the liquid non-ionic surfactants described above, for example the Surfactant T8 (whether prepared directly as such or as a mixture of Surfactant T7 and Surfactant T9), used alone or in combination with a minor amount of an anionic, cationic, amphoteric or zwitterionic surfactant. These other types of ionic and amphoteric surfactants are very well known in the art and any of these known surfactants can be used.

Accordingly, the highly preferred compositions of this invention are surfactant mixtures of (A) a liquid non-ionic surfactant, (B) a non-ionic surfactant having an organic hydrophobic moiety and an organic hydrophilic moiety, said hydrophilic moiety including an hydroxyl group at its terminus, which has been modified to convert said terminal hydroxyl group to a moiety having a carboxyl group, (i.e. an acid-terminated non-ionic surfactant), and (C) a cationic surfactant, preferably an ethoxylated quaternary ammonium salt surfactant.

The amount of the component (A) is generally in the range of from about 40% to about 90%, preferably from about 50% to about 80%, based on the surfactant mixture, and the total amount of components (B) plus (C) is correspondingly, from about 10% to about 60%, preferably from about 20% to about 50% of the surfactant mixture. Furthermore, up to about 20%, preferably up to about 10%, especially preferably up to about 5% of the liquid non-ionic surfactant may be replaced by another, e.g. an anionic, surfactant, such as, for example, linear alkyl benzene sulfonate, paraffin sulfonate, olefin sulfonate, alcohol sulfate, etc.

In addition to the surfactant mixture of (A), (B) and (C), the invention detergent composition may also and preferably does include water soluble detergent builder salts. Typical suitable builders include, for example, those disclosed in U.S. Pat. Nos. 4,316,812, 4,264,466, and 3,630,929. Water-soluble inorganic alkaline builder salts which can be used alone with the detergent compound or in admixture with other builders are alkali metal carbonate, borates, phosphates, polyphosphates, bicarbonates, and silicates. (Ammonium or substituted ammonium salts can also be used.) Specific examples of such salts are sodium tripolyphosphate, sodium carbonate, sodium tetraborate, sodium pyrophosphate, potassium pyrophosphate, sodium bicarbonate, potassium tripolyphosphate, sodium hexametaphosphate, sodium sesquicarbonate, sodium mono and diorthophosphate, and potassium bicarbonate. Sodium tripolyphosphate (TPP) is especially preferred. The alkali metal silicates are useful builder salts which also function to make the composition anticorrosive to washing machine parts. Sodium silicates of $Na_2O/SiO_2$ ratios of from 1.6/1 to 1/3.2 especially about $\frac{1}{2}$ to 1/2.8 are preferred. Potassium silicates of the same ratios can also be used.

Another class of builders useful herein are the water-insoluble aluminosilicates, both of the crystalline and amorphous type. Various crystalline zeolites (i.e. alumino-silicates) are described in British Patent No. 1,504,168, U.S. Pat. No. 4,409,136 and Canadian Patent Nos. 1,072,835 and 1,087,477, all of which are hereby incorporated by reference for such descriptions. An example of amorphous zeolites useful herein can be found in Belgium Patent No. 835,351 and this patent too is incorporated herein by reference. The zeolites generally have the formula $$(M_2O)_x \cdot (Al_2O_3)_y \cdot (SiO_2)_z \cdot WH_2O$$

wherein x is 1, y is from 0.8 to 1.2 and preferably 1, z is from 1.5 to 3.5 or higher and preferably 2 to 3 and w is from 0 to 9, preferably 2.5 to 6 and M is preferably sodium. A typical zeolite is type A or similar structure, with type 4A particularly preferred. The preferred aluminosilicates have calcium ion exchange capacities of about 200 milliequivalents per gram or greater, e.g. 400 meq/g.

Other materials such as clays, particularly of the water-insoluble types, may be useful adjuncts in compositions of this invention. Particularly useful is bentonite. This material is primarily montmorillonite which is a hydrated aluminum silicate in which about 1/6th of the aluminum atoms may be replaced by magnesium atoms and with which varying amounts of hydrogen, sodium, potassium, calcium, etc., may be loosely combined. The bentonite in its more purified form (i.e. free from any grit, sand, etc.) suitable for detergents invariably contains at least 50% montmorillonite and thus its cation exchange capacity is at least about 50 to 75 meq. per 100 g. of bentonite. Particularly preferred bentonite are the Wyoming or Western U.S. bentonites which have been sold as Thixo-jels 1, 2, 3 and 4 by Georgia Kaolin Co. These bentonites are known to soften textiles as described in British Patent No. 401,413 to Marriott and British Patent No. 461,221 to Marriott and Dugan.

Examples of organic alkaline sequestrant builder salts which can be used alone with the detergent or in admixture with other organic and inorganic builders are alkali metal, ammonium or substituted ammonium, aminopolycarboxylates, e.g. sodium and potassium ethylene diaminetetraacetate (EDTA), sodium and potassium nitrilotriacetates (NTA) and triethanolammonium N-(2-hydroxyethyl)nitrilodiacetates. Mixed salts of these polycarboxylates are also suitable.

Other suitable builders of the organic type include carboxymethylsuccinates, tartronates and glycollates. Of special value are the polyacetal carboxylates. The polyacetal carboxylates and their use in detergent compositions are described in U.S. Pat. Nos. 4,144,226; 4,315,092 and 4,146,495. Other patents on similar builders include U.S. Pat. Nos. 4,141,676; 4,169,934; 4,201,858; 4,204,852; 4,224,420; 4,225,685; 4,226,960;

4,233,422; 4,233,423; 4,302,564 and 4,303,777. Also relevant are European Patent Application Nos. 0015024; 0021491 and 0063399.

Since the compositions of this invention are generally highly concentrated, and, therefore, may be used at relatively low dosages, it is desirable to supplement any phosphate builder (such as sodium tripolyphosphate) with an auxiliary builder such as a polymeric carboxylic acid having high calcium binding capacity to inhibit encrustation which could otherwise be caused by formation of an insoluble calcium phosphate. Such auxiliary builders are also well known in the art.

Various other detergent additives or adjuvants may be present in the detergent product to give it additional desired properties, either of functional or aesthetic nature. Thus, there may be included in the formulation, minor amounts of soil suspending or anti-redeposition agents, e.g. polyvinyl alcohol, fatty amides, sodium carboxymethyl cellulose, hydroxy-propyl methyl cellulose; optical brighteners, e.g. cotton, amide and polyester brighteners, for example, stilbene, triazole and benzidine sulfone compositions, especially sulfonated substituted triazinyl stilbene, sulfonated naphthotriazole stilbene, benzidene sulfone, etc., most preferred are stilbene and triazole combinations.

Bluing agents such as ultramarine blue; enzymes, preferably proteolytic enzymes, such as subtilisin, bromelin, papain, trypsin and pepsin, as well as amylase type enzymes, lipase type enzymes, and mixtures thereof; bactericides, e.g. tetrachlorosalicylanilide, hexachlorophene; fungicides; dyes; pigments (water dispersible); preservatives; ultraviolet absorbers; anti-yellowing agents, such as sodium carboxymethyl cellulose, complex of $C_{12}$ to $C_{22}$ alkyl alcohol with $C_{12}$ to $C_{18}$ alkylsulfate; pH modifiers and pH buffers; color safe bleaches, perfume, and anti-foam agents or suds-suppressors, e.g. silicon compounds can also be used.

The bleaching agents are classified broadly, for convenience, as chlorine bleaches and oxygen bleaches. Chlorine bleaches are typified by sodium hypochlorite (NaOCl), potassium dichloroisocyanurate (59% available chlorine), and trichloroisocyanuric acid (85% available chlorine). Oxygen bleaches are represented by sodium and potassium perborates, percarbonates, and perphosphates, and potassium monopersulfate. The oxygen bleaches are preferred and the perborates, particularly sodium perborate monohydrate is especially preferred.

The peroxygen compound is preferably used in admixture with an activator therefor. Suitable activators are those disclosed in U.S. Pat. No. 4,264,466 or in column 1 of U.S. Pat. No. 4,430,244. Polyacylated compounds are preferred activators; among these, compounds such as tetraacetyl ethylene diamine ("TAED") and pentaacetyl glucose are particularly preferred.

The activiator usually interacts with the peroxygen compound to form a peroxyacid bleaching agent in the wash water. It is preferred to include a sequestering agent of high complexing power to inhibit any undesired reaction between such peroxyacid and hydrogen peroxide in the wash solution in the presence of metal ions. Preferred sequestering agents are able to form a complex with $Cu^{2+}$ ions, such that the stability constant (pK) of the complexation is equal to or greater than 6, at 25° C., in water, of an ionic strength of 0.1 mole/liter, pK being conventionally defined by the formula: $pK = -\log K$ where K represents the equilibrium constant. Thus, for example, the pK values for complexation of copper ion with NTA and EDTA at the stated conditions are 12.7 and 18.8, respectively. Suitable sequestering agents include for example, in addition to those mentioned above, diethylene triamine pentaacetic acid (DETPA); diethylene triamine pentamethylene phosphonic acid (DTPMP); and ethylene diamine tetramethylene phosphonic acid (EDITEMPA).

The composition may also contain an inorganic insoluble thickening agent or dispersant of very high surface area such as finely divided silica of extremely fine particle size (e.g. of 5–100 millimicrons diameters such as sold under the name Aerosil) or the other highly voluminous inorganic carrier materials disclosed in U.S. Pat. No. 3,630,929, in proportions of 0.1–10%, e.g. 1 to 5%. It is preferable, however, that compositions which form peroxyacids in the wash bath (e.g. compositions containing peroxygen compound and activator therefor) be substantially free of such compounds and of other silicates; it has been found, for instance, that silica and silicates promote the undesired decomposition of the peroxyacid.

In a preferred form of the invention, the mixture of liquid nonionic surfactant and solid ingredients is subjected to an attrition type of mill in which the particle sizes of the solid ingredients are reduced to less than about 10 microns, e.g. to an average particle size of 2 to 10 microns or even lower (e.g. 1 micron). Compositions whose dispersed particles are of such small size have improved stability against separation or settling on storage.

In the grinding operation, it is preferred that the proportion of solid ingredients be high enough (e.g. at least about 40% such as about 50%) that the solid particles are in contact with each other and are not substantially shielded from one another by the nonionic surfactant liquid. Mills which employ grinding balls (ball mills) or similar mobile grinding elements have given very good results. Thus, one may use a laboratory batch attritor having 8 mm diameter steatite grinding balls. For larger scale work a continuously operating mill in which there are 1 mm or 1.5 mm diameter grinding balls working in a very small gap between a stator and a rotor operating at a relatively high speed (e.g. a CoBall mill) may be employed; when using such a mill, it is desirable to pass the blend of nonionic surfactant and solids first through a mill which does not effect such fine grinding (e.g. a colloid mill) to reduce the particle size to less than 100 microns (e.g., to about 40 microns) prior to the step of grinding to an average particle diameter below about 10 microns in the continuous ball mill.

The detergent compositions may also advantageously include a viscosity-controlling and gel-inhibiting agent in order to lower the temperature at which the nonionic surfactant will form a gel when added to water. Such viscosity controlling and gel-inhibiting agents may be, for example, lower alkanol, e.g. ethyl alcohol (see U.S. Pat. No. 3,953,380), alkali metal formates and adipates (see U.S. Pat. No. 4,368,147), hexylene glycol, polyethylene glycol, and others. However, an especially preferred class of viscosity-controlling and gel-inhibiting compounds which can be used in the liquid non-ionic detergent compositions of this invention are alkylene glycol ether compounds represented by the following general formula $$RO(\overset{R'}{\overset{|}{C}}HCH_2O)_nH$$

where R is a $C_1$–$C_5$, preferably $C_2$ to $C_5$, especially preferably $C_2$ to $C_4$, and particularly $C_4$ alkyl group, R′ is H or $CH_3$, preferably H, and n is a number of from about 1 to 4, preferably 2 to 4 on average.

Preferred examples of these gel inhibiting compounds include ethylene glycol monoethyl ether ($C_2H_5$—O—$CH_2CH_2OH$), and diethylene glycol monobutyl ether ($C_4H_9$—O—$(CH_2CH_2O)_2H$). Diethylene glycol monoethyl ether is especially preferred because it is uniquely effective to control viscosity.

The use of these glycol ether viscosity control and gel-inhibiting agents in substantially non-aqueous built liquid non-ionic detergent compositions is disclosed in the copending, commonly assigned application titled "LIQUID LAUNDRY DETERGENT COMPOSITION AND METHOD OF USE" which was filed on or about the same day as the subject application under Ser. No. 687,815.

While the preferred gel-inhibiting compounds, particularly diethylene glycol monobutyl ether, can be the only viscosity control and gel inhibiting additive in the invention compositions further improvements in the rheological properties of the anhydrous liquid nonionic surfactant compositions can be obtained by including in the composition a small amount of a nonionic surfactant which has been modified to convert a free hydroxyl group thereof to a moiety having a free carboxyl group, as disclosed in the aforementioned commonly assigned, copending application Ser. No. 597,948, filed Apr. 9, 1984, such as a partial ester of a nonionic surfactant and a polycarboxylic acid and/or an acidic organic phosphorus compound having an acidic - POH group, such as a partial ester of phosphorous acid and an alkanol.

The free carboxyl group modified nonionic surfactants, which may be the same as, or different from component (B), and which may be broadly characterized as polyether carboxylic acids, function to lower the temperature at which the liquid nonionic forms a gel with water. The acidic polyether compound can also decrease the yield stress of such dispersions, aiding in their dispensibility, without a corresponding decrease in their stability against settling. Suitable polyether carboxylic acids contain a grouping of the formula $$\left(OCH_2-CH_2\right)_p\left(OCH(CH_3)-CH_2\right)_q-Y-Z-COOH$$

where Y is oxygen or sulfur, Z is an organic linkage, p is a positive number of from about 3 to about 50 and q is zero or a positive number of up to 10. Specific examples include the half-ester of Plurafac RA30 with succinic anhydride, the half ester of Dobanol 25-7 with succinic anhydride, the half ester of Dobanol 91-5 with succinic anhydride, etc. Instead of a succinic acid anhydride, other polycarboxylic acids or anhydrides may be used, e.g. maleic acid, maleic anhydride, glutaric acid, malonic acid, succinic acid, phthalic acid, phthalic anhydride, citric acid, etc. Furthermore, other linkages may be used, such as ether, thioether or urethane linkages, formed by conventional reactions. For instance, to form an ether linkage, the nonionic surfactant may be treated with a strong base (to convert its OH group to an ONa group for instance) and then reacted with a halocarboxylic acid such as chloroacetic acid or chloropropionic acid or the corresponding bromo compound. Thus, the resulting carboxylic acid may have the formula R—Y—ZCOOH where R is the residue of a nonionic surfactant (on removal of a terminal OH), Y is oxygen or sulfur and Z represents an organic linkage such as a hydrocarbon group of, say, one to ten carbon atoms which may be attached to the oxygen (or sulfur) of the formula directly or by means of an intervening linkage such as an oxygen-containing linkage, e.g. a $$-\overset{O}{\overset{\|}{C}}- \text{ or } -\overset{O}{\overset{\|}{C}}-NH-,$$

etc.

The polyether carboxylic acid may be produced from a polyether which is not a nonionic surfactant, e.g. it may be made by reaction with a polyalkoxy compound such as polyethylene glycol or a monoester or monoether thereof which does not have the long alkyl chain characteristic of the nonionic surfactants. Thus, R may have the formula $$R^1(\overset{R^2}{\overset{|}{C}}H-CH_2)_n-$$

where $R^2$ is hydrogen or methyl, $R^1$ is alkylphenyl or alkyl or other chain terminating group and "n" is at least 3 such as 5 to 25. When the alkyl of $R^1$ is a higher alkyl, R is a residue of a nonionic surfactant. As indicated above $R^1$ may instead be hydrogen or lower alkyl (e.g. methyl, ethyl, propyl, butyl) or lower acyl (e.g. acetyl, etc.). The acidic polyether compound if present in the detergent composition, is preferably added dissolved in the nonionic surfactant.

When the component (B) is used in a molar excess of the component (C) cationic surfactant, the excess acid-terminated non-ionic may function as a gel-inhibiting agent.

As disclosed in the commonly assigned copending application Ser. No. 597,793, filed Apr. 6, 1984, the disclosure of which is incorporated herein by reference, the acidic organic phosphorus compound having an acidic—POH group can increase the stability of the suspension of builder, especially polyphosphate builders, in the nonaqueous liquid nonionic surfactant.

The acidic organic phosphorus compound may be, for instance, a partial ester of phosphoric acid and an alcohol such as an alkanol which has a lipophilic character, having, for instance, more than 5 carbon atoms, e.g. 8 to 20 carbon atoms.

A specific example is a partial ester of phosphoric acid and a $C_{16}$ to $C_{18}$ alkanol (Empiphos 5632 from Marchon); it is made up of about 35% monoester and 65% diester.

The inclusion of quite small amounts of the acidic organic phosphorus compound makes the suspension significantly more stable against settling on standing but remains pourable, presumably, as a result of increasing the yield value of the suspension, but decreases its plastic viscosity. It is believed that the use of the acidic phosphorus compound may result in the formation of a high energy physical bond between the—POH portion of the molecule and the surfaces of the inorganic polyphosphate builder so that these surfaces take on an organic character and become more compatible with the nonionic surfactant.

The acidic organic phosphorous compound may be selected from a wide variety of materials, in addition to the partial esters of phosphoric acid and alkanols mentioned above. Thus, one may employ a partial ester of phosphoric or phosphorous acid with a mono or polyhydric alcohol such as hexylene glycol, ethylene glycol, di- or tri-ethylene glycol or higher polyethylene glycol, polypropylene glycol, glycerol, sorbitol, mono or diglycerides of fatty acids, etc. in which one, two or more of the alcoholic OH groups of the molecule may be esterified with the phosphorus acid. The alcohol may be a nonionic surfactant such as an ethoxylated or ethoxylatedpropoxylated higher alkanol, higher alkyl phenol, or higher alkyl amide. The—POH group need not be bonded to the organic portion of the molecule through an ester linkage; instead it may be directly bonded to carbon (as in a phosphonic acid, such as a polystyrene in which some of the aromatic rings carry phosphonic acid or phosphinic acid groups; or an alkylphosphonic acid, such as propyl or laurylphosphonic acid) or may be connected to the carbon through other intervening linkage (such as linkages through O, S or N atoms). Preferably, the carbon:phosphorus atomic ratio in the organic phosphorus compound is at least about 3:1, such as 5:1, 10:1, 20:1, 30:1 or 40:1.

The liquid mixed surfactant compositions preferably include therein at least one detergent builder suspended in the liquid non-ionic surfactant. Suitable ranges of the surfactant and builder components include from about 0.5 to 1 part by weight of (A) non-ionic liquid surfactant; from about 0.12 to 5 parts by weight of (B) acid-terminated non-ionic surfactant plus (C) cationic surfactant at a weight ratio of (B) to (C) in the range of from about 3:1 to 1:3, and from about 0.8 to 3 parts by weight of said at least one detergent builder salt, preferably at least one inorganic detergent builder salt, especially preferably alkali metal polyphosphate, e.g. sodium tripolyphosphate.

Furthermore, as described above one or more additional detergent adjuvants or additives can be included in the formulation to provide specific functions commonly associated with heavy duty laundry detergents. Bleaching agents, for example are preferred additives. Optical brighteners, dyes, perfumes, enzymes, chelating agents, etc., are also commonly used and highly beneficial additives.

In the preferred heavy duty liquid detergent compositions of the invention, typical proportions (based on the total composition, unless otherwise specified) of the ingredients are as follows:

(A) liquid non-ionic surfactant—from about 20 to 80%, preferably about 30 to 70%, especially preferably about 40 to 60%;

(B) acid-terminated non-ionic surfactant from about 10 to 40%, preferably about 15 to 35%, especially preferably about 20 to 30%;

(C) cationic surfactant—from about 10 to 40%, preferably from about 15 to 35%, especially preferably about 20 to 30%;

the sum of (A)+(B)+(C) being from about 30 to 100% by weight of the total composition, preferably from about 40 to 90% by weight of the total composition;

(C) detergent builder(s)—up to about 60%, preferably within the range of about 10 to 60%, such as about 20 to 50%, especially about 25 to 40%;

(E) viscosity-controlling and gel-inhibiting agent(s): (i) alkylene glycol ethers: up to about 20%, for example from about 2 to 15%; (ii) polyether carboxylic acid gel-inhibiting compound up to about 10%, for example about 1 to 10%, preferably about 2 to 8%; (iii) others, e.g. lower ($C_1$–$C_4$) alkanols, glycols, etc. - up to about 10%, preferably up to about 5%, for example 0.5 to 2%;

(F) acidic organic phosphoric acid compound, as antisettling agent: up to 5%, for example, in the range of 0.01 to 5%, such as about 0.05 to 2%, preferably about 0.1 to 1%

Suitable ranges of other optional detergent additives are: enzymes—0 to 2%, especially 0.7 to 1.3%; corrosion inhibitors—about 0 to 40%, and preferably 5 to 30%; anti-foam agents and suds-suppressors—0 to 15%, preferably 0 to 5%, for example 0.1 to 3%; thickening agent and dispersants—0 to 15%, for example 0.1 to 10%, preferably 1 to 5%; soil suspending or anti-redeposition agents and anti-yellowing agents—0 to 10%, preferably 0.5 to 5%; colorants, perfumes, brighteners and bluing agents total weight 0% to about 2% and preferably 0% to about 1%; pH modifiers and pH buffers—0 to 5%, preferably 0 to 2%; bleaching agent—0% to about 40% and preferably 0% to about 25%, for example 2 to 20%; bleach stabilizers and bleach activators 0 to about 15%, preferably 0 to 10%, for example, 0.1 to 8%; sequestering agent of high complexing power, in the range of up to about 5%, preferably about ¼ to 3%, such as about ½ to 2%. In the selections of the adjuvants, they will be chosen to be compatible with the main constituents of the detergent composition.

All proportions and percentages are by weight unless otherwise indicated.

It is understood that the foregoing detailed description is given merely by way of illustration and the variations may be made therein without departing from the spirit of the invention.

The preferred liquid non-ionic detergent compositions of this invention are substantially anhydrous, although minor amounts of water, e.g. up to about 5%, preferably up to about 2%, especially less than 1%, can be tolerated.

The mixed acid-terminated non-ionic/cationic surfactant complex of this invention is also useful in aqueous cleaning compositions as well as in powder detergent compositions for its enhanced cleaning performance, especially in laundry detergent compositions. The detergent mixture may be used in place of part or all of the conventional detergent surfactant component of the usual aqueous or powder detergent compositions. In order to demonstrate the improved detergency, i.e. cleaning performance, achieved by using both of the acid-terminated non-ionic surfactant and the cationic surfactant, as compared to the effects achieved using only one of these two surfactants, the following tests were performed: A liquid non-ionic surfactant composition was prepared with the following ingredients:

| | Amount (grams) |
|---|---|
| Surfactant T7 | 0.375 |
| Surfactant T9 | 0.375 |
| Sodium tripolyphosphate | 1.5 |
| Mixure of: | 0.25 |
| Acid terminated nonionic | |
| Cationic Surfactant | |

The acid terminated non-ionic was acid terminated Dobanol 91-5 prepared in Example C.

The cationic surfactant was Ethoquat 2T14 which is available from Armak Chemical Co. and is a ditallow tetraethoxylated ammonium salt.

The ratio of the acid terminated non-ionic and cationic surfactants in the 0.25 gram mixture was varied as follows 1:0, 3:1, 1:1, 1:3 and 0:1. Each of the resulting five formulations was added to a bowl containing 600 ml tapwater at 40° C. or 60° C. In each solution, 6 Krefield soiled swatches were cleaned. The ΔRd values were measured. The results are shown in the following table:

| Ratio acid terminated non-ionic cationic in 0.25 gram mixture | ΔRd | |
|---|---|---|
| | 40° C. | 60° C. |
| 1:0 | 8.1 | 16.0 |
| 3:1 | 9.3 | 16.5 |
| 1:1 | 11.4 | 18.3 |
| 1:3 | 11.9 | 18.0 |
| 0:1 | 10.4 | 12.2 |

These results clearly demonstrate the improved cleaning performance of the mixture of acid terminated non-ionic surfactant with the cationic surfactant, especially at the 1:1 mixing ratios.

What we claim is:

1. A substantially non-aqueous liquid detergent composition comprising a surfactant mixture of from about 40% to about 90% by weight of (a) a liquid nonionic surfactant, and from about 10% to about 60% by weight of a complex of (B) an acid-modified nonionic surfactant which is an esterification reaction product between a nonionic surfactant which is a poly(C2 to C3 alkoxylated) fatty alcohol having a terminal hydroxyl group with a polycarboxylic acid or polycarboxylic acid anhydride, and (C) an ethoxylated or propoxylated quaternary ammonium salt surfactant having the formula (I)

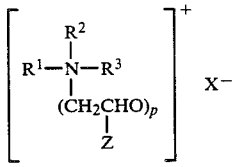

(I)

wherein $R^1$ is an organic group containing a straight or branched alkyl or alkenyl group optionally substituted with up to 3 phenyl or hydroxy groups, and optionally interrupted by up to 4 structures selected from the group consisting of

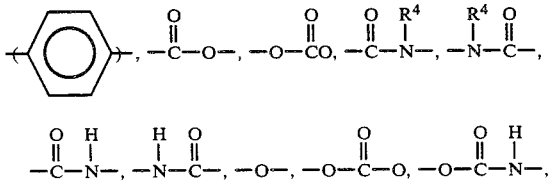

-continued

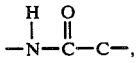

and mixtures thereof, where $R^4$ is an alkyl or hydroxyalkyl group containing 1 to 4 carbon atoms, or a benzyl group, and which contains from about 8 to 22 carbon atoms, and which may additionally contain up to 12 ethylene oxide groups, $R^2$ is the group $R^1$ or an alkyl or hydroxyalkyl group containing 1 to 6 carbon atoms, or a benzyl group; $R^3$ is the group $R^2$ or $(CH_2CHZO)_qH$; Z is hydrogen or methyl, and q and p are, independently, numbers from 1 to 12; and X is a water-soluble anion, said complex comprising a molar ratio of (B)/(C) in the range of from about 3:1 to 1:3.

2. The composition of claim 1 which further comprises at least one detergent builder salt suspended throughout said liquid non-ionic surfactant (A).

3. The composition of claim 1 which further comprises an inorganic detergent builder salt which is stably suspended in said surfactant mixture.

4. The composition of claim 3 wherein said builder salt comprises sodium tripolyphosphate.

5. The composition of claim 3 wherein the builder salt comprises from about 30% to about 75% by weight of the composition.

6. The composition of claim 5 which comprises from about 0.5 to 1 part by weight of (A), from about 0.12 to 5 parts by weight of (B) plus (C) at a molar ratio of (B) to (C) in the range of from about 1.5:1 to 1 1.5, and from about 0.8 to 3 parts by weight of inorganic detergent builder salt.

7. The compositions of claim 1 wherein (B) and (C) are present at a molar ratio of from about 1.5:1 to about 1:1.5.

8. The composition of claim 1 wherein the liquid non-ionic surfactant (A) comprises at least one compound selected from the group consisting of $C_{10}$ to $C_{18}$ fatty alcohols which include from 3 to 12 moles of $C_2$ to $C_3$ alkylene oxide per mole of fatty alcohol.

9. The composition of claim 1 wherein (B) and (C) are present at a molar ratio of about 1:1.

10. The composition of claim 1 wherein the nonionic surfactant (A) is a linear secondary $C_{13}$ fatty alcohol condensed with an average 8 moles ethylene oxide per mole of fatty alcohol, and in which no more than 10% by weight of the molecules are condensed with less than 7 or more than 9 moles of ethylene oxide and wherein the quaternary ammonium salt surfactant (C) comprises a compound of formula (I) wherein $R^1$ is an alkyl or alkenyl group having from about 10 to 20 carbon atoms which may be substituted by an hydroxyl group, and which may additionally contain up to 12 ethylene oxide groups;

$R^2$ is the group $R^1$ or an alkyl or hydroxyalkyl group containing 1 to 4 carbon atoms, or a benzyl group;

$R^3$ is the group R2 or $(CH_2CHZO$;

Z is a hydrogen atom; and

P and q are, independently, numbers from 1 to 12.

11. The composition of claim 10 wherein $R^3$ has the same meaning as $R^2$.

12. The composition of claim 10 wherein $R^3$ is the group $(C_2H_4O)_qH$ wherein q is a number from 1 to 12.

* * * * *